US009022823B2

(12) United States Patent
Sakamoto

(10) Patent No.: US 9,022,823 B2
(45) Date of Patent: May 5, 2015

(54) EXHAUST STRUCTURE OF OUTBOARD MOTOR

(71) Applicant: Suzuki Motor Corporation, Hamamatsu-shi, Shizuoka (JP)

(72) Inventor: Hiroki Sakamoto, Hamamatsu (JP)

(73) Assignee: Suzuki Motor Corporation, Shizouka (JP)

( * ) Notice: Subject to any disclaimer, the term of this patent is extended or adjusted under 35 U.S.C. 154(b) by 105 days.

(21) Appl. No.: 13/708,223

(22) Filed: Dec. 7, 2012

(65) Prior Publication Data

US 2013/0149921 A1 Jun. 13, 2013

(30) Foreign Application Priority Data

Dec. 9, 2011 (JP) ..... 2011-270534

(51) Int. Cl.
*B63H 23/26* (2006.01)
*B63H 20/26* (2006.01)

(52) U.S. Cl.
CPC ..... *B63H 20/26* (2013.01)

(58) Field of Classification Search
CPC ..... B63H 20/26; B63H 23/321; B63H 5/165; B63H 2023/323; B63H 2023/327; B63H 20/245; B63H 2001/185; B63H 21/28; B63H 21/34; B63H 23/34; B63H 23/36; F01N 13/12; Y02T 10/47
USPC ..... 440/89 R, 89 A, 71
See application file for complete search history.

(56) References Cited

U.S. PATENT DOCUMENTS 4,911,663 A * 3/1990 Meier ..... 440/49
5,522,703 A * 6/1996 Okamoto ..... 416/93 A

FOREIGN PATENT DOCUMENTS

JP 55-085999 6/1980

* cited by examiner

*Primary Examiner* — S. Joseph Morano
*Assistant Examiner* — Andrew Polay
(74) *Attorney, Agent, or Firm* — Troutman Sanders LLP

(57) ABSTRACT

Exhaust gas from an engine passes through a lower unit, and passes through a propeller boss coupled to a propeller shaft to be discharged into water. A stopper is provided at a rear end portion of a gear case of the lower unit, and a bush is inserted into and attached to an inner surface of the stopper. An inside diameter of the bush is set to substantially the same diameter as an outside diameter of a front end portion of the propeller boss, and the bush and the propeller boss are disposed by being overlapped with each other in an axial direction.

6 Claims, 11 Drawing Sheets

EXHAUST STRUCTURE OF OUTBOARD MOTOR

CROSS-REFERENCE TO RELATED APPLICATIONS

This application is based upon and claims the benefit of priority of the prior Japanese Patent Application No. 2011-270534, filed on Dec. 9, 2011, the entire contents of which are incorporated herein by reference.

BACKGROUND OF THE INVENTION

1. Field of the Invention

The present invention relates to an exhaust structure for discharging exhaust gas after combustion to the outside in an outboard motor on which an internal combustion engine is mounted as a power source.

2. Description of the Related Art

In this type of outboard motor, an engine output torque is transmitted from a drive shaft to a propeller shaft, and a propeller disposed at a rear part of the outboard motor is rotated, to thereby obtain a thrust. The propeller has a cylindrical boss, and is attached to the propeller shaft with this boss portion. Exhaust gas from an engine passes through the boss to be discharged into water.

Generally, a gap between an outside diameter of a front end portion of a propeller boss and an inside diameter of a rear end portion of a gear case cannot be set to a value equal to or less than a certain value for avoiding a contact due to a swing of the propeller. In this case, there is a possibility that exhaust gas passing through an inside of the propeller boss is leaked from the gap. When the leaked exhaust gas is led into the propeller, and if this state continues, a propulsion efficiency of the propeller is decreased.

Accordingly, an outboard motor disclosed in Patent Document 1, for example, employs a structure in which a rear end portion of a gear case or a cover of the gear case is protruded so that an inner periphery and an outer periphery of a front end portion of a propeller boss are overlapped. With such a structure, a leakage of exhaust gas is prevented.

[Patent Document 1] Japanese Utility Model Application Laid-open No. 55-085999

In the outboard motor disclosed in Patent Document 1, although a labyrinth structure is formed between the front end portion of the propeller boss and the rear end portion of the gear case, even in this case, there is required a gap, to no small extent, to prevent a contact between the both due to a swing of a propeller shaft. Accordingly, it was not always possible to achieve a sufficient effect of preventing a leakage of exhaust gas.

SUMMARY OF THE INVENTION

The present invention has been made in view of such a situation, and an object thereof is to provide an exhaust structure of an outboard motor providing an excellent effect of preventing a leakage of exhaust gas and improving and maintaining an exhaust performance.

An exhaust structure of an outboard motor of the present invention being an exhaust structure of an outboard motor in which exhaust gas from an engine is designed to pass through a lower unit, and pass through a propeller boss coupled to a propeller shaft to be discharged into water, the exhaust structure of the outboard motor is characterized in that it includes a stopper provided at a rear end portion of a gear case of the lower unit, and a bush inserted into and attached to an inner surface of the stopper, in which an inside diameter of the bush is set to substantially the same diameter as an outside diameter of a front end portion of the propeller boss, and the bush and the propeller boss are disposed by being overlapped with each other in an axial direction.

The exhaust structure of the outboard motor of the present invention is characterized in that the bush is formed of a synthetic resin material.

The exhaust structure of the outboard motor of the present invention is characterized in that a retaining projection is formed on the bush on an insertion side with respect to the stopper.

The exhaust structure of the outboard motor of the present invention is characterized in that an escape portion is formed on an attachment portion of the bush of the stopper.

DETAILED DESCRIPTION OF THE PREFERRED EMBODIMENTS

Hereinafter, a preferred embodiment of an exhaust structure of an outboard motor according to the present invention will be described based on the drawings.

Figure 1:
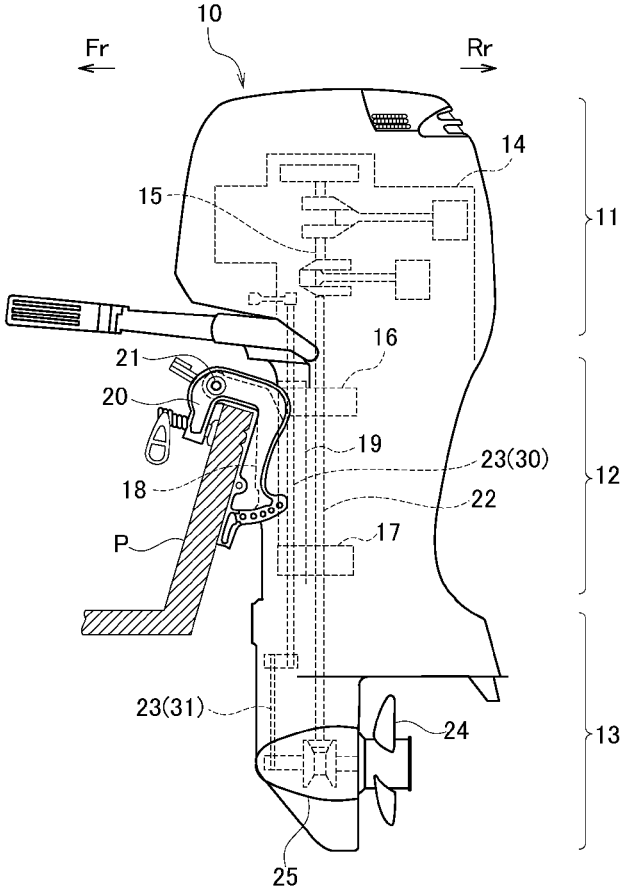
FIG. 1 is a left side view illustrating a schematic configuration example of an outboard motor according to the present invention.

FIG. 1 is a left side view illustrating a schematic configuration example of an outboard motor 10 according to the present invention. In this case, the outboard motor 10 is fixed, at its front side, to a rear stern plate P of a hull, as illustrated in the drawing. Note that in the following description, the front of the outboard motor 10 is indicated by an arrow mark Fr, the rear is indicated by an arrow mark Rr, and the right on the side of the outboard motor 10 is indicated by an arrow mark R and the left on the side is indicated by an arrow mark L, respectively, as necessary in each drawing.

In the whole configuration of the outboard motor 10, an engine unit or power unit 11, a middle unit 12, and a lower unit 13 are arranged in order from the top to the bottom. In the engine unit 11, an engine 14 is mounted and supported to be vertically placed, through an engine base, so that its crank shaft 15 is oriented in the vertical direction. Note that, as the engine 14, a V-type multicylinder engine can be employed, for example. The middle unit 12 is supported around and integrally rotatable with a supporting shaft 19 set on a swivel bracket 18 through an upper mount 16 and a lower mount 17. On both right and left sides of the swivel bracket 18, a clamp bracket 20 is provided, and the outboard motor 10 is fixed to the rear stern plate P of the hull through the clamp bracket 20. The swivel bracket 18 is supported to be rotatable in the upward and downward directions, around a tilt shaft 21 set in the right and left directions.

In the middle unit 12, a drive shaft 22 coupled to a lower end portion of the crank shaft 15 is disposed to penetrate in the upward and downward directions, so that a driving force of the drive shaft 22 is transmitted to a later-described propeller shaft in a gear case of the lower unit 13. On the front side of the drive shaft 22, a shift rod 23 for switching between forward and rearward travels and the like is disposed to be parallel to the upward and downward directions. The shift rod 23 includes an upper shift rod 30 and a lower shift rod 31. Note that the middle unit 12 has a drive shaft housing that houses the drive shaft 22. Further, an oil pan storing oil for lubricating the engine unit 11 is disposed in the middle unit 12.

The lower unit 13 has a gear case 25 including a plurality of gears and so on which rotationally drive a propeller 24 by the driving force of the drive shaft 22. The drive shaft 22 extending downward from the middle unit 12 finally rotates the propeller 24 by a gear attached to the drive shaft 22 meshing with the gear in the gear case 25, and the shift rod 23 operates to switch, namely, shift the power transmission path of the gear device in the gear case 25.

Figure 2:
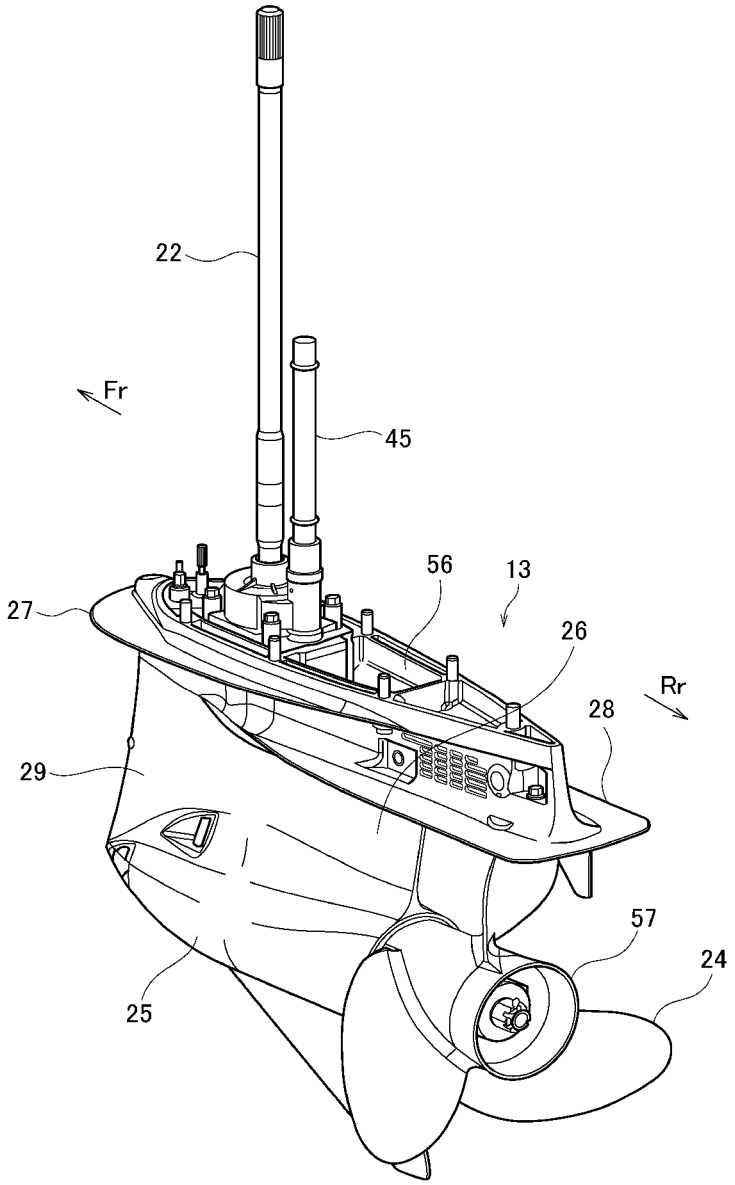
FIG. 2 is a rear perspective view of a lower unit of the outboard motor according to the present invention.
Figure 3:
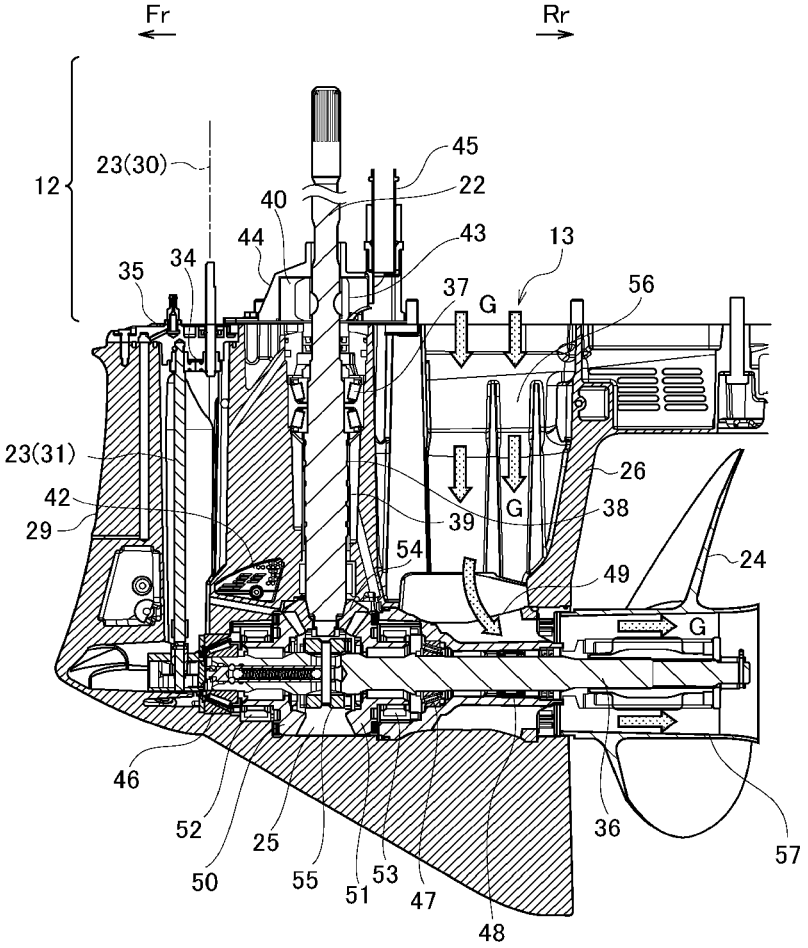
FIG. 3 is a longitudinal sectional view along an axial direction of propeller of the lower unit of the outboard motor according to the present invention.
Figure 4:
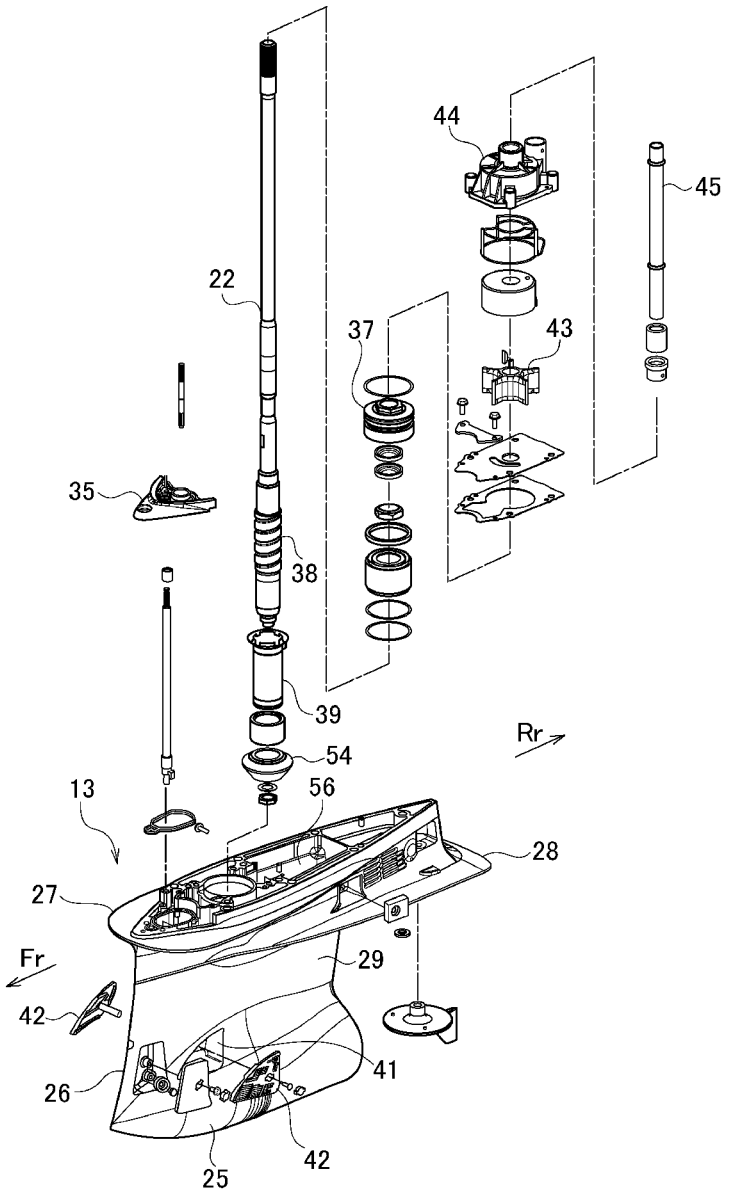
FIG. 4 is an exploded perspective view of a part in the vicinity of a casing of the lower unit in the outboard motor according to the present invention.
Figure 5:
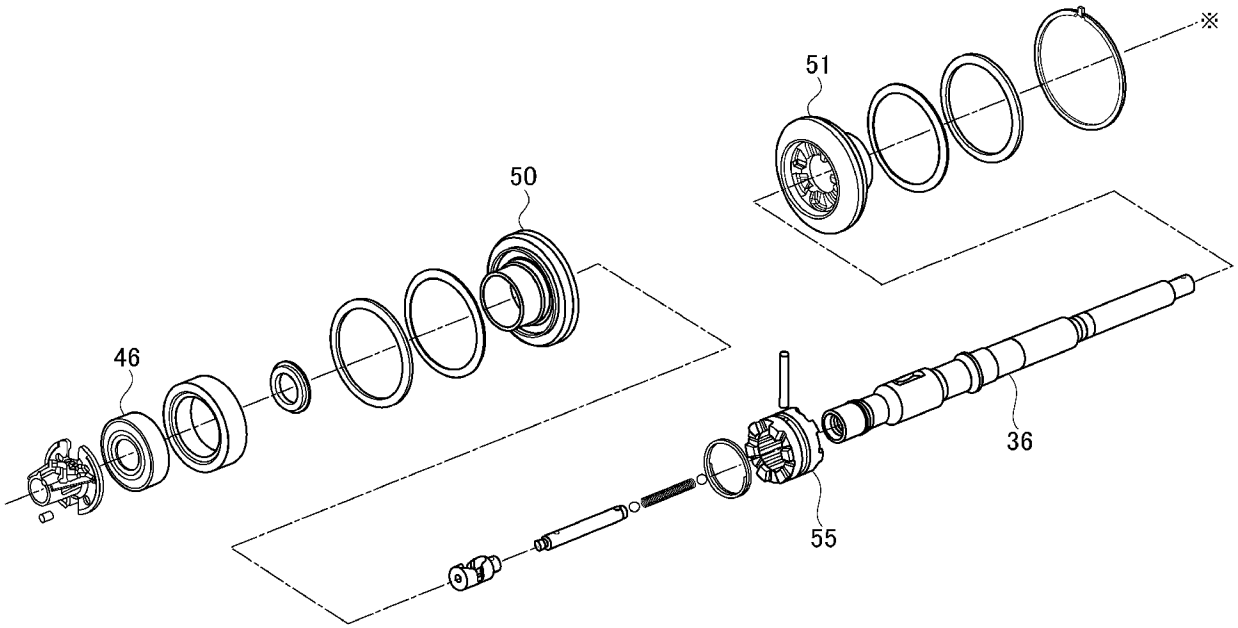
FIG. 5 is an exploded perspective view illustrating a main configuration in a gear case of the outboard motor according to the present invention.
Figure 6:
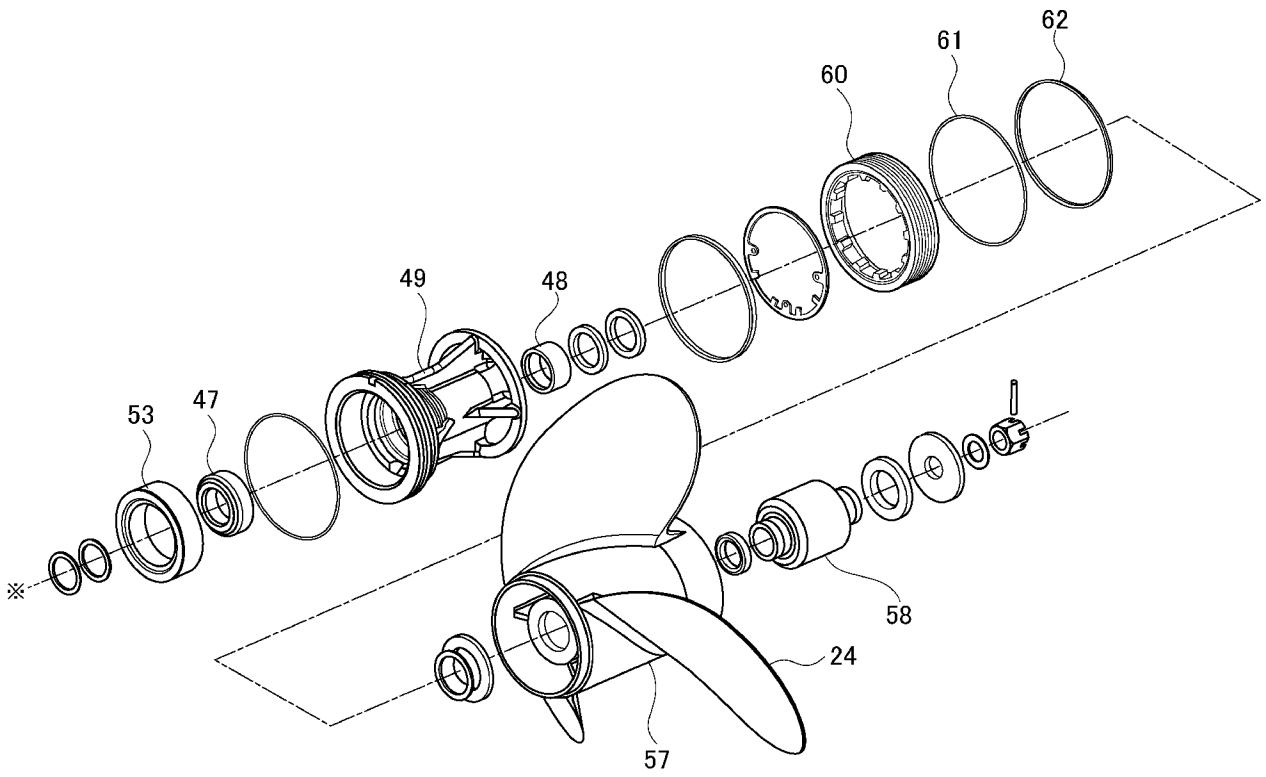
FIG. 6 is an exploded perspective view illustrating a main configuration in the gear case of the outboard motor according to the present invention.

FIG. 2 to FIG. 6 illustrate a concrete configuration example of the lower unit 13. FIG. 2 is a rear perspective view of the lower unit 13, FIG. 3 is a longitudinal sectional view along an axial direction of propeller of the lower unit 13, FIG. 4 is an exploded perspective view of a part in the vicinity of a casing of the lower unit 13, and FIG. 5 and FIG. 6 are views respectively illustrating a main configuration in the gear case 25. Note that in FIG. 5 and FIG. 6, it is set that components are mutually connected as indicated by a mark ·X·. First, in a casing 26 which is integrally formed as illustrated in FIG. 2 or FIG. 4, there are provided an anti-splash plate 27 and an anti-cavitation plate 28 disposed at top and bottom in the vicinity of a mating surface with the middle unit 12, and on a lower part of a leg part 29 extending downward of these plates, there is provided the gear case 25 disposed to exhibit a bullet shape in the forward and rearward directions.

The shift rod 23 is inserted and supported in the upward and downward directions on a side of a pointed end portion of the bullet shape of the gear case 25 in the casing 26. Note that the shift rod 23 is practically configured by being divided into two, which are, the upper shift rod 30 which is extended to a region from the engine unit 11 to the middle unit 12, and the lower shift rod 31 which is disposed in the lower unit 13, as illustrated in FIG. 3. Note that the upper shift rod 30 is rotationally driven via a link mechanism by a driving force of a not-illustrated actuator provided on the engine unit 11 side, and the rotation is further transmitted to the lower shift rod 31 via a coupling gear 34 formed of a pair of drive gear 32 and driven gear 33. A coupling portion between the upper shift rod 30 and the lower shift rod 31 is set to be held by a shift rod housing 35 fixed to an upper surface of the casing 26. As illustrated in FIG. 3, the shift rod 23, namely, the lower shift rod 31 is vertically extended to a position intersecting an extension of an axis of a propeller shaft 36.

Further, as illustrated in FIG. 3, the drive shaft 22 is inserted and supported in the vicinity of substantially a center portion in the forward and rearward directions of the leg part 29 in the casing 26. In this case, the drive shaft 22 is supported in a rotatable manner in the casing 26 via a back-to-back tapered roller bearing 37, for example, in the vicinity of an upper part of the leg part 29, and a lower end portion thereof is vertically extended to reach the inside of the gear case 25. On a part below the tapered roller bearing 37 of the drive shaft 22, a spiral recessed groove 38 is carved, and a collar 39 is fitted to a periphery of the recessed groove 38 with a very small gap provided between the collar and an outer peripheral surface of the drive shaft 22.

When the drive shaft 22 is rotated, the spiral recessed groove 38 performs a function of supplying oil or an oil pump function, and forms an oil circulation path for supplying lubricant oil to main parts and members which need to be lubricated in the casing 26. Note that an oil pump for lubrication for the engine unit 11 is arranged separately from one formed of this recessed groove 38.

On the upper surface of the casing 26, a cooling water pump 40 is attached so as to be pivotally fitted to the drive shaft 22. The cooling water pump 40 takes in water from water outside the outboard motor 10 to supply cooling water to the engine unit 11 side. In this case, a water intake 41 is provided in the vicinity of a lower part on the front side of the casing 26 as illustrated in FIG. 4, and although detailed illustration is omitted, the cooling water pump 40 and the water intake 41 are connected by a cooling water channel in the inside of the casing 26. Note that to the water intake 41, a cover 42 having a filter function with respect to foreign matters and the like is attached. As illustrated in FIG. 3, the water intake 41 is disposed between the drive shaft 22 and the lower shift rod 31 in the forward and rearward directions.

As illustrated in FIG. 3 and FIG. 4, in the cooling water pump 40, an impeller 43 is fixed to the drive shaft 22, and the impeller 43 is housed in a pump case 44. When the drive shaft 22 is rotated, pressurized cooling water is discharged from the cooling water pump 40, and the cooling water is fed via a cooling water pipe 45, and is finally supplied to the engine unit 11 side.

In the gear case 25, the propeller shaft 36 is disposed along the forward and rearward directions as illustrated in FIG. 3, and is supported in a rotatable manner via a plurality of bearings 46, 47 and 48. Note that among the above, the bearings 47 and 48 are held in a bearing housing 49. At a position below a lower end portion of the drive shaft 22, a pair of front and rear forward gear 50 and reverse gear 51 are supported in a rotatable manner via bearings 52 and 53, respectively, in a concentric state and in a loose-fitted state with respect to the propeller shaft 36. These gears constantly mesh with a drive gear 54 fixed to the lower end portion of the drive shaft 22. In this example, the forward gear 50 and the reverse gear 51 are disposed on the front Fr side and on the rear Rr side, respectively, and a dog clutch 55 is arranged between these gears.

In the above-described configuration, when the hull is made to travel forward, for example, there is formed a power transmission path from the forward gear 50 to the propeller shaft 36 via the dog clutch 55, through a shift operation. When the engine 14 is started, an output torque thereof is transmitted to the drive shaft 22, and the propeller shaft 36 is rotated via the forward gear 50, which rotates the propeller 24, resulting in that the outboard motor 10, namely, the hull on which the outboard motor 10 is mounted, travels forward. It is designed such that exhaust gas discharged from the engine 14 at this time passes through the inside of the outboard motor 10, and is finally discharged from a part of the propeller 24.

Specifically, there is formed, from the middle unit 12 to the lower unit 13, an exhaust passage 56 which is communicated with an exhaust manifold of the engine 14, as illustrated in FIG. 3. The exhaust passage 56 is formed so that exhaust gas flows from above the bearing housing 49 into a later-described gap of the bearing housing 49, at the rear side of the drive shaft 22. In this case, a propeller boss 57 of the propeller 24 is formed in a substantially cylindrical shape and practically has a hollow structure, and exhaust gas G passes through the bearing housing 49 from the exhaust passage 56, and passes through the propeller boss 57 to be discharged to the rear of the propeller boss 57, as indicated by arrow marks.

Figure 7A:
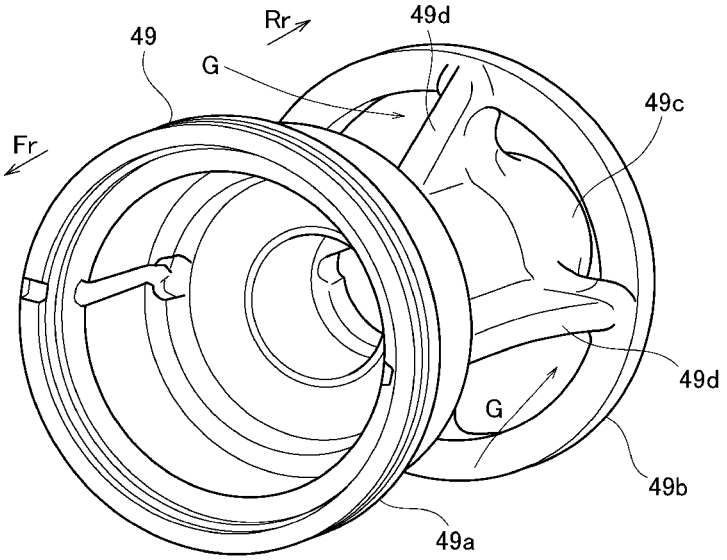
FIG. 7A is a front perspective view.
Figure 7B:
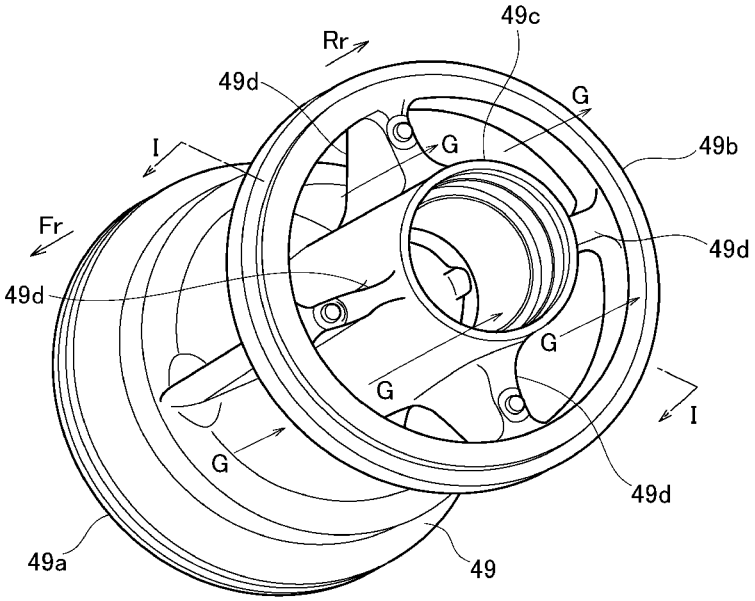
FIG. 7B is a rear perspective view illustrating a configuration example of a bearing housing according to the present invention.
Figure 11A:
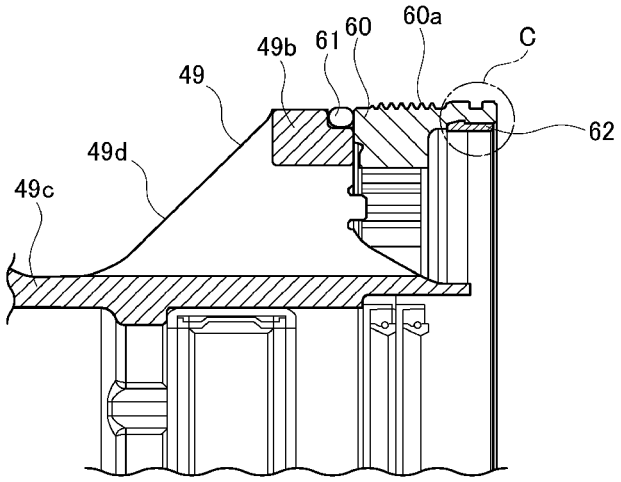
FIG. 11A is a partial sectional view illustrating a state where the bush is attached to the stopper according to the present invention.
Figure 11B:
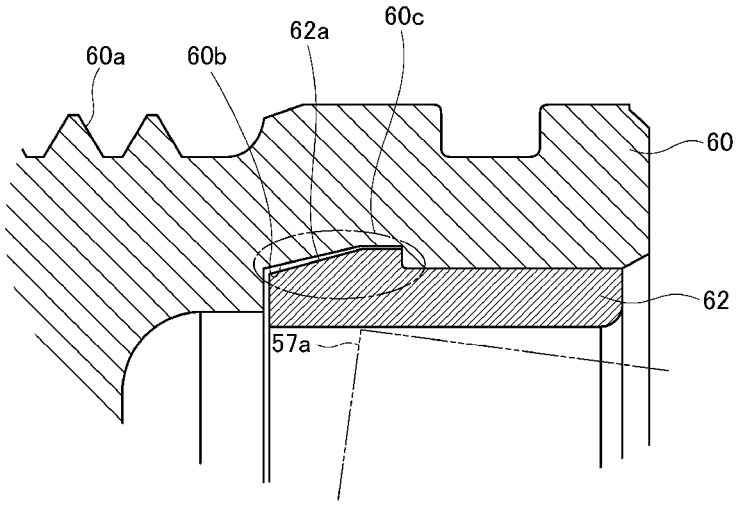
FIG. 11B is an enlarged view of C part in FIG. 11A.

Here, FIGS. 7A, 7B illustrate a configuration example of the bearing housing 49. The bearing housing 49 generally has a cylindrical body having different diameters in which a diameter changes along an axial direction or a longitudinal direction, and includes a front portion 49*a* and a rear portion 49*b* with a large diameter and a cylindrical portion 49*c* with a small diameter connecting these portions. The rear portion 49*b* and the cylindrical portion 49*c* are coupled by a plurality of ribs 49*d* radially projecting from the cylindrical portion 49*c*. These ribs 49*d* are extended in the axial direction, and a gap or a hollow space is formed between the mutual ribs 49*d*. The gap functions as the above-described exhaust passage 56. Note that to the front portion 49*a*, the bearing 53 and the bearing 47 are attached, and further, to the cylindrical portion 49*c*, the bearing 48 is attached. Note that in relation to FIGS. 7A, 7B, the bearing housing 49 in FIG. 3 is illustrated by a cross section taken along a I-I line in FIG. 7B. The same applies to FIG. 8, FIGS. 11A, 11B and the like.

Figure 8:
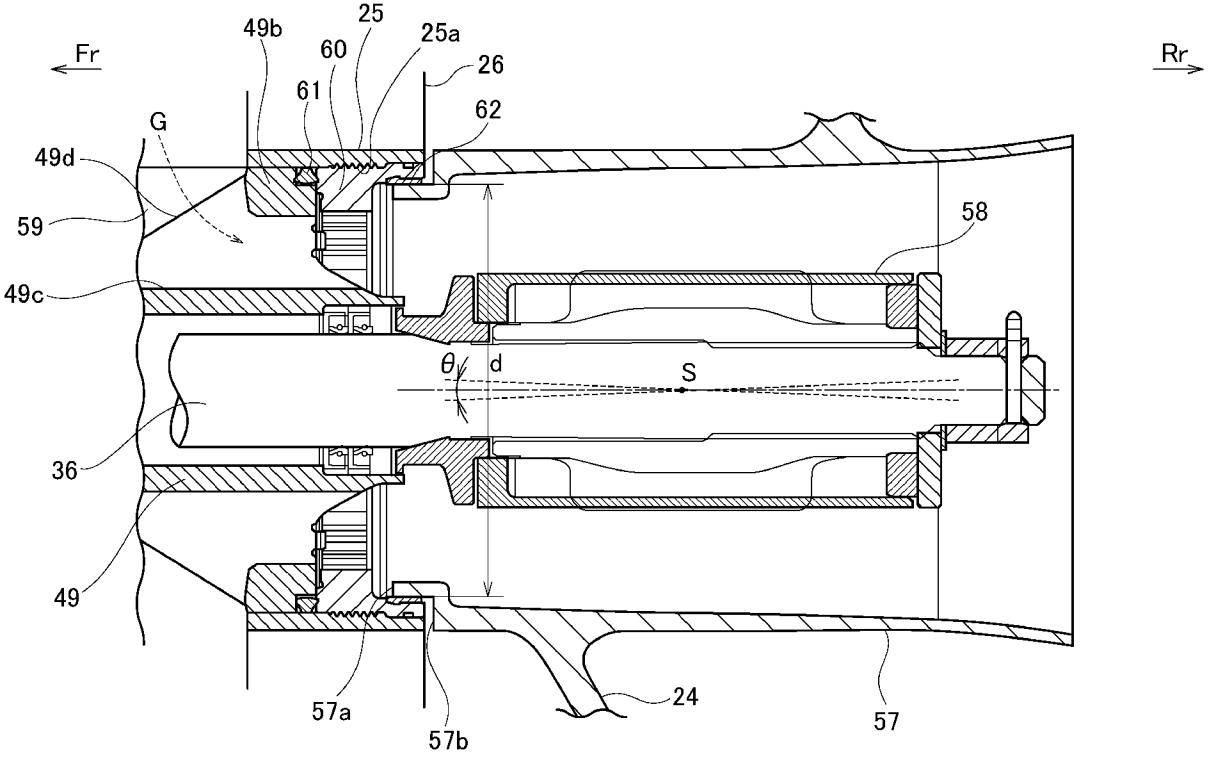
FIG. 8 is a sectional view of a part in the vicinity of a propeller boss illustrating a configuration of substantial part in an exhaust structure of the outboard motor according to the present invention.

Next, FIG. 8 illustrates a configuration of substantial part of the exhaust structure of the present invention. The propeller boss 57 is pivotally fitted to a rear end portion of the propeller shaft 36 via a propeller bush 58, and is fastened and fixed by a locknut. On an opening side of the rear part of the gear case 25 (casing 26) in which the propeller shaft 36 is inserted to be disposed, a housing part 59 for housing the bearing housing 49 is provided, and the bearing housing 49 is inserted to be fitted into the housing part 59 from the rear. The bearing housing 49 inserted to be fitted into the housing part 59 is fixed by a stopper 60 which is screwed into the rear end portion of the gear case 25. Note that an O ring 61 is attached between the bearing housing 49 and the stopper 60. Further, a bush 62 is inserted into an inner surface of the stopper 60.

Figure 9C:
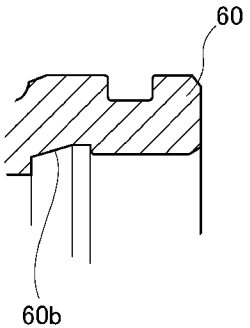
FIG. 9C is an enlarged view of A part in FIG. 9B.
Figure 9B:
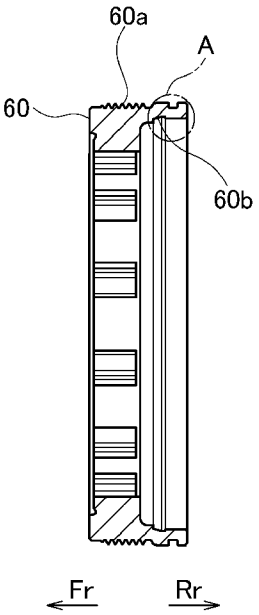
FIG. 9B is a sectional view taken along a II-II line in FIG. 9A.
Figure 9A:
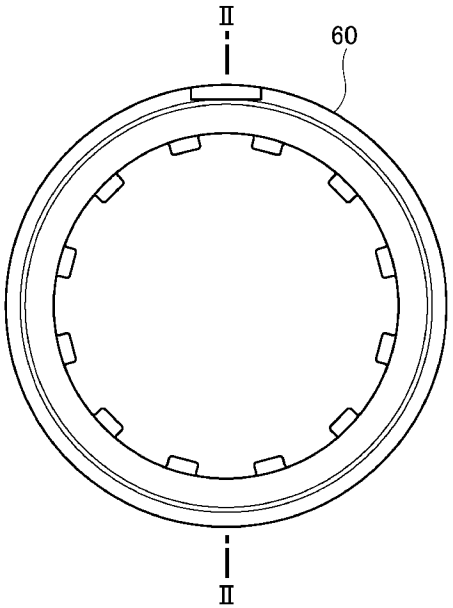
FIG. 9A is a front view illustrating a configuration example of a stopper according to the present invention.

Here, FIGS. 9A, 9B, 9C illustrate a configuration example of the stopper 60. The stopper 60 generally has a ring shape, and on an outer peripheral portion thereof, there is formed a screw portion 60*a* (male screw) which is screwed together with a screw portion 25*a* (female screw) formed on the opening of the rear part of the gear case 25. Further, on an inner peripheral portion of the stopper 60, there is formed an attachment guide portion 60*b* for attaching the bush 62. The bush 62 is inserted into the attachment guide portion 60*b*, so that the attachment guide portion 60*b* is practically formed in a shape and a size that match those of an outer peripheral portion of the bush 62.

Figure 10A:
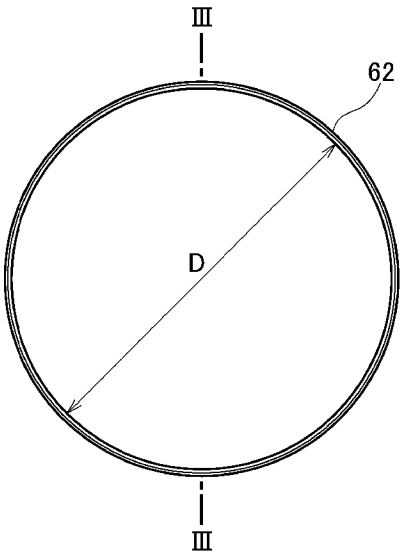
FIG. 10A is a front view illustrating a configuration example of a bush according to the present invention.
Figure 10B:
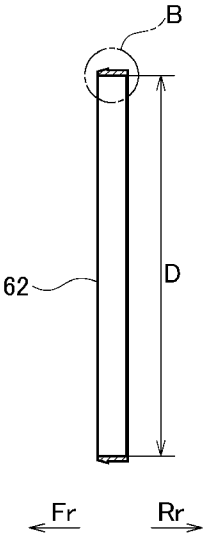
FIG. 10B is a sectional view taken along a line in FIG. 10A.
Figure 10C:
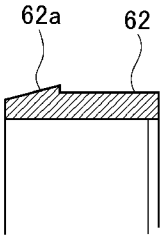
FIG. 10C is an enlarged view of B part in FIG. 10B.

Further, FIGS. 10A, 10B, 10C illustrate a configuration example of the bush 62. The bush 62 is generally formed in a ring shape by using a synthetic resin material, and has a certain length in the forward and rearward directions (axial direction), as illustrated in FIG. 10B. As illustrated in FIG. 10C, there is formed a retaining projection 62*a* on an insertion side with respect to the stopper 60. This projection 62*a* is formed in a harpoon shape with a hook, for example, and it is designed such that when the projection 62*a* is engaged with the attachment guide portion 60*b* of the stopper 60 as illustrated in FIGS. 11, the bush 62 is prevented from coming off from the stopper 60.

In particular, an inside diameter D of the bush (refer to FIGS. 10A, 10B) is set to substantially the same diameter as an outside diameter d of a front end portion 57*a* of the propeller boss 57 (refer to FIG. 8), and the bush 62 and the front end portion 57*a* of the propeller boss 37 are disposed by being overlapped with each other in the axial direction, as illustrated in FIG. 8. Note that in this example, a stepped portion 57*b* is formed adjacent to the front end portion 57*a* of the propeller boss 57.

Further, the bush 62 is inserted into the stopper 60 as described above, and as illustrated in FIGS. 11A, 11B there is formed, on the attachment guide portion 60*b*, an escape portion 60*c* with respect to the projection 62*a* of the bush 62. Specifically, it is designed such that when the bush 62 is attached to the stopper 60, there is formed a predetermined gap, namely, the escape portion 60*c*, between the attachment guide portion 60*b* of the stopper 60 and the projection 62*a* of the bush 62.

When the engine 14 is started in the above-described configuration, the exhaust gas passes through the exhaust passage 56 configured by including the gap of the bearing housing 49, and passes through the propeller boss 57 to be discharged to the rear of the propeller boss 57, as described above. In this case, since the bush 62 is attached between the stopper 60 and the propeller boss 57, particularly, a portion in the vicinity of the front end portion 57*a*, there is no chance that the exhaust gas is leaked from a portion between the rear end portion of the gear case 25 and the front end portion 57*a* of the propeller boss 57, because of a sealing action provided by the bush 62. Therefore, there is no chance that the leaked exhaust gas is led into the rotating propeller 24, resulting in that a high propulsion efficiency of the propeller 24 can be secured and maintained.

In this case, the inside diameter D of the bush 62 and the outside diameter d of the front end portion 57*a* of the propeller boss 57 are set to substantially the same diameter, so that it is possible to secure the effective and proper sealing action provided by the bush 62. Besides, since the bush 62 and the front end portion 57*a* of the propeller boss 57 are disposed by being overlapped with each other in the axial direction, as illustrated in FIG. 8 and the like, the effect of preventing the leakage of exhaust gas is more secured.

Here, when the propeller 24 is rotated, there is a chance that a swing of shaft of the propeller 24, namely, a swing of the propeller shaft 36 occurs due to an influence of variation in an applied load with respect to the propeller 24 and the like. For example, as illustrated in FIG. 8, there is a swing center S of the propeller 24 in the vicinity of substantially a center portion in the axial direction of the propeller boss 57. Further, the swing angle is set to θ, which is illustrated in a somewhat exaggerated manner for the sake of drawing convenience. It can be assumed that, by corresponding to the swing of the propeller 24, the front end portion 57*a*, in particular, of the propeller boss 57 is brought into contact or partially brought into contact with the inner peripheral portion of the bush 62, as indicated by a two-dot chain line in FIG. 11B. Even when such a contact or the like occurs, the bush 62 is made of the synthetic resin and thus it has a flexibility, so that it is possible to effectively maintain the sealing action while absorbing an impact due to the contact, to thereby prevent the leakage of exhaust gas. Further, even if the bush 62 is deformed due to the contact with the propeller boss 57, since the projection 62*a* of the bush 62 is engaged with the attachment guide portion 60*b* of the stopper 60, the bush 62 can be prevented from coming off from the stopper 60.

Further, since the escape portion 60*c* with respect to the projection 62*a* of the bush 62 is formed on the attachment guide portion 60*b* of the stopper 60, it is possible to make the deformed bush 62 to be escaped into the escape portion 600. Accordingly, it is possible to minimize the damage and the like of the bush 62 itself while preventing the leakage of exhausts gas, and to secure the proper and good exhaust performance over a long period of time by improving the durability of the bush 62.

The present invention has been described above together with various embodiments, but, the present invention is not limited to these embodiments, and modifications and the like can be made within the scope of the present invention.

For example, the inside diameter D of the bush 62 and the outside diameter d of the front end portion 57*a* of the propeller boss 57 are set to substantially the same diameter, but, the relation in size between the inside diameter D and the outside diameter d can be appropriately selected according to need.

According to the present invention, the bush is attached between the stopper and the propeller boss, and with the bush, it is possible to effectively prevent exhaust gas from being leaked from a portion between the gear case and the propeller boss. Accordingly, since there is no chance that leaked exhaust gas is led into the rotating propeller, it is possible to secure and maintain a high propulsion efficiency of the propeller. In this case, by appropriately setting the relation in size between the inside diameter of the bush and the outside diameter of the propeller boss, the positional relationship between the both, and the like, the effect of preventing the leakage of exhaust gas is more secured.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An exhaust structure of an outboard motor in which exhaust gas from an engine is designed to pass through a lower unit, and pass through a propeller boss coupled to a propeller shaft to be discharged into water, the exhaust structure of the outboard motor comprising:

a stopper provided at a rear end portion of a gear case of the lower unit; and a bush inserted into and attached to an inner surface of said stopper, wherein an inside diameter of said bush is set to substantially the same diameter as an outside diameter of a front end portion of the propeller boss, and said bush and the propeller boss are disposed by being overlapped with each other in an axial direction, said bush is attached to an inner surface of a rear portion of said stopper, an inside diameter of the rear portion of said stopper is formed larger than that of a front portion of said stopper, and an inside diameter of the front end portion of the propeller boss is larger than an inside diameter of the front portion of said stopper.

2. The exhaust structure of the outboard motor according to claim 1, wherein said bush is formed of a synthetic resin material.

3. The exhaust structure of the outboard motor according to claim 1, wherein a retaining projection is formed on said bush on an insertion side with respect to said stopper, and the retaining projection is formed on an outer surface of said bush on the insertion side with respect to said stopper to project toward an outside in a radial direction.

4. The exhaust structure of the outboard motor according to claim 2, wherein a retaining projection is formed on said bush on an insertion side with respect to said stopper, and the retaining projection is formed on an outer surface of said bush on the insertion side with respect to said stopper to project toward an outside in a radial direction.

5. The exhaust structure of the outboard motor according to claim 3, wherein an escape portion is formed on an attachment portion of said bush of said stopper, the escape portion of the attachment portion of said bush is a gap formed between the inner surface of the rear portion of said stopper and the retaining projection formed on the outer surface of said bush, and said bush is deformable toward the outside in the radial direction in the gap.

6. The exhaust structure of the outboard motor according to claim 4, wherein an escape portion is formed on an attachment portion of said bush of said stopper, the escape portion of the attachment portion of said bush is a gap formed between the inner surface of the rear portion of said stopper and the retaining projection formed on the outer surface of said bush, and said bush is deformable toward the outside in the radial direction in the gap.

* * * * *